US008641235B2

(12) United States Patent
Galatas

(10) Patent No.: US 8,641,235 B2
(45) Date of Patent: Feb. 4, 2014

(54) LIGHT, LIGHT FIXTURE ASSEMBLY, AND PATIENT MODULE FOR USE IN A MEDICAL SETTING

(76) Inventor: David E. Galatas, Raleigh, NC (US)

( * ) Notice: Subject to any disclaimer, the term of this patent is extended or adjusted under 35 U.S.C. 154(b) by 266 days.

(21) Appl. No.: 13/297,773

(22) Filed: Nov. 16, 2011

(65) Prior Publication Data

US 2013/0118503 A1 May 16, 2013

(51) Int. Cl.
*A61G 15/10* (2006.01)
*F21V 15/00* (2006.01)

(52) U.S. Cl.
USPC ..... 362/253; 601/86; 601/24; 433/29; 433/21

(58) Field of Classification Search
USPC ..... 433/21, 29; 700/1; 601/86, 24
See application file for complete search history.

(56) References Cited

U.S. PATENT DOCUMENTS 7,499,760 B2 * 3/2009 Rose et al. ..... 700/1
8,066,651 B2 * 11/2011 Richard Vitton ..... 601/24

OTHER PUBLICATIONS

Tracking Light Monitor product, http://www.dentalproductshopper.com/track-light-monitor, last accessed Jan. 3, 2012.

* cited by examiner

*Primary Examiner* — Anabel Ton
(74) *Attorney, Agent, or Firm* — NK Patent Law, PLLC

(57) ABSTRACT

A patient module for use in a medical setting is provided. The patient module includes a patient seating assembly and at least one of a medical instrument for use in providing treatment to a patient. At least one member having an articulated joint is provided. The member has a first end configured for engagement with a structure and a second end configured for engagement with a light for illuminating a treatment area of the patient. A display screen is carried by the light for displaying images for viewing by the patient. The display screen may be integrally formed with the light within a housing.

20 Claims, 9 Drawing Sheets

LIGHT, LIGHT FIXTURE ASSEMBLY, AND PATIENT MODULE FOR USE IN A MEDICAL SETTING

TECHNICAL FIELD

This disclosure is related to a light, light fixture assembly, and patient module for use in a medical setting, and more particularly towards a light, light fixture assembly, and patient module having a display screen for viewing by a patient in a medical setting.

BACKGROUND

Lights are used in medical settings for illuminating a treatment area of a patient. For example, a high-intensity light may be employed in a surgical setting for illuminating a cavity or a surgical sight. In another example, a low-intensity light may be employed in a dental setting for illuminating the mouth or treatment area of a patient.

In many of these medical settings, the patient may focus their eyesight onto the light. This may cause the patient to have nausea or even visual damage. Furthermore, the patient focusing their eyesight on the light may not be most advantageous for maintaining the patient in a fixed position. Maintaining the patient in a fixed position is desirous for use in a surgical or medical treatment setting, particularly so when a doctor, dentist, surgeon, or the like is using one or more medical instruments to perform an operation or treatment on the patient.

Maintaining the patient in a fixed position by focusing their eyesight towards a desired location during treatment is important for achieving proper treatment. However, maintaining the patient's focus while using conventional medical lights is difficult because the lights do not have aspects or features that are capable of maintaining the patient's focus. Accordingly, a need remains for a device or apparatus that addresses these problems.

SUMMARY

This Summary is provided to introduce a selection of concepts in a simplified form that are further described below in the Detailed Description of Illustrative Embodiments. This Summary is not intended to identify key features or essential features of the claimed subject matter, nor is it intended to be used to limit the scope of the claimed subject matter.

Disclosed herein is a light fixture assembly. The assembly includes a support that includes at least one member having an articulated joint. The support has a first end configured for engagement with a structure and a second end configured for engagement with a light for illuminating a treatment area of a patient. A display screen is carried by the light for displaying images for viewing by the patient.

According to one or more embodiments, the at least one member includes a plurality of members. Each successive member is engaged by each prior member by the articulated joint.

According to one or more embodiments, the display screen is carried on an uppermost surface of the light.

According to one or more embodiments, the light assembly further includes speaker assemblies carried by the display screen for outputting audible sounds.

According to one or more embodiments, each of the light and the display screen are defined within an integrally formed housing.

According to one or more embodiments, the casing further defines one or more handles for receiving movement forces from an operator.

According to one or more embodiments, the structure is one of a patient seating assembly and a ground surface.

According to one or more embodiments, a light assembly for use in a medical setting is provided. The light assembly includes a light for illuminating a treatment area of a patient, and a display screen carried by the light for displaying images for viewing by the patient.

According to one or more embodiments, a patient module for use in a medical setting is provided. The patient module includes a patient seating assembly and at least one of a medical instrument for use in providing treatment to a patient. A support that includes at least one member having an articulated joint is provided. The at least one member has a first end configured for engagement with a structure and a second end configured for engagement with a light for illuminating a treatment area of the patient. A display screen is carried by the light for displaying images for viewing by the patient.

According to one or more embodiments, a light fixture assembly is provided. The assembly includes a support that includes at least one member having an articulated joint. the support has a first end configured for engagement with a structure and a second end configured for engagement with a light for illuminating a treatment area of a patient. A display screen is carried by the support for displaying images for viewing by the patient and configured such that movement of the light imparts corresponding movement to the display screen.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed invention is not limited to the specific methods and instrumentalities disclosed. In the drawings.

DETAILED DESCRIPTION

The presently disclosed invention is described with specificity to meet statutory requirements. However, the description itself is not intended to limit the scope of this patent. Rather, the inventors have contemplated that the claimed invention might also be embodied in other ways, to include different steps or elements similar to the ones described in this document, in conjunction with other present or future technologies.

Figure 1:
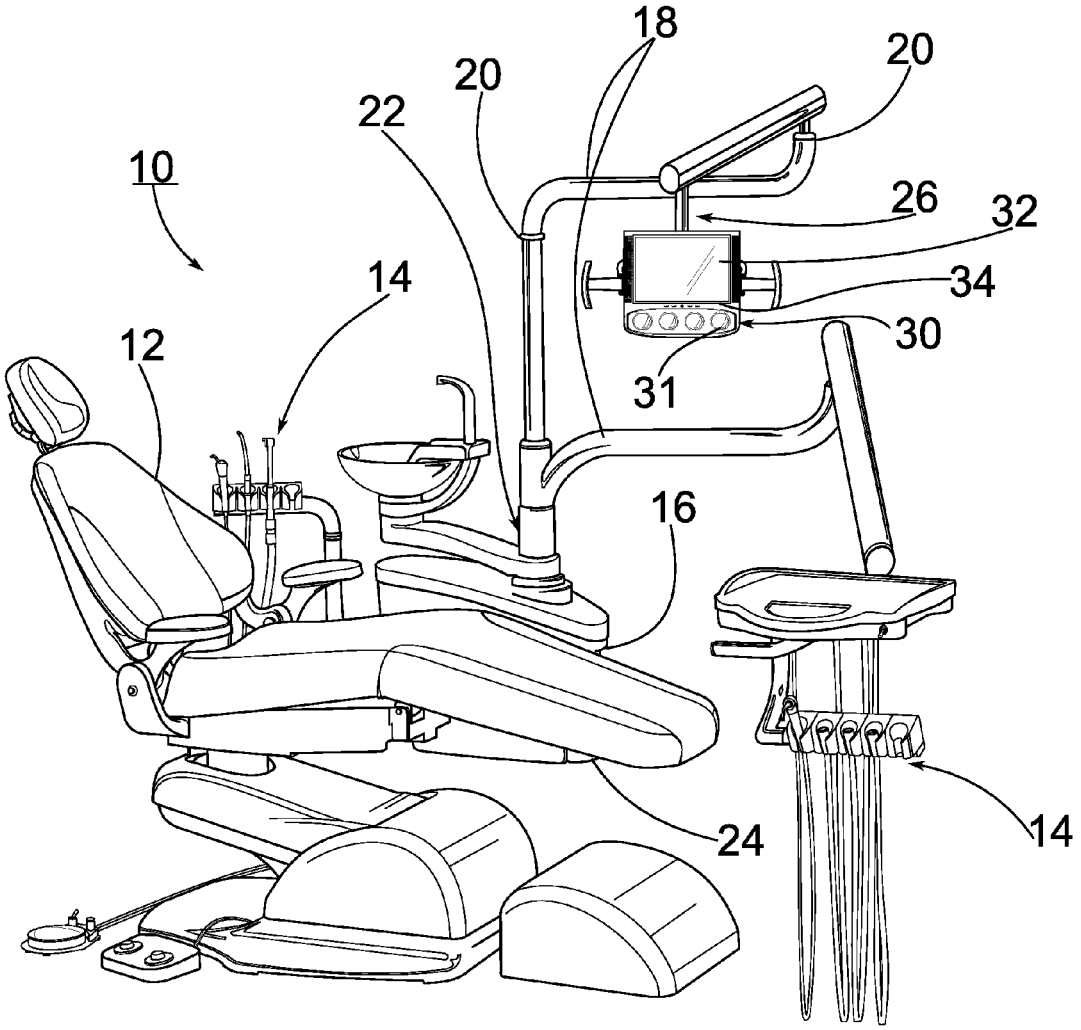
FIG. 1 illustrates a perspective view of a patient module having a light with a display screen carried thereby according to one or more embodiments disclosed herein.

A patient module for use in a medical setting according to one or more embodiments is disclosed in FIG. 1 and generally designated 10. The patient module 10 may include a patient seating assembly 12 on which the patient may sit or lay during a medical procedure or operation. The patient seating assembly 12 may be, for example, a conventional patient chair as illustrated in FIG. 1. The seating assembly 12 may include any of a plurality of features and functions, including the ability to place the seat back in any of a reclined, upright, or lay flat position. The patient module 10 may include one or more medical instruments 14 for use in providing treatment to a patient. The medical instruments may include any appropriately configured medical device, including tools and devices for surgeons, physicians, dentists, and the like. One or more instruments 14 for use in a dental setting are illustrated in FIG. 1.

The patient module 10 may include a support 16. The support 16 may include a member 18 or a plurality thereof. Each member 18 may have an articulated joint 20 that may be configured for pivotal or hinged movement with any appropriate degrees of freedom. One member 18 has a first end 22 that may be configured for engagement with a structure 24 and one of another member 18 may have a second end 26 configured for engagement with a light assembly 30 for illuminating a treatment area of the patient. As illustrated, the structure 24 may be a base or other structure of the seating assembly 12, or may alternatively be a ceiling or ground structure.

A display screen 32 may be carried by the light for displaying images for viewing by the patient. The display screen 32 may be carried on an uppermost surface 34 of the light assembly 30 as illustrated in FIG. 1, or may alternatively be positioned anywhere within close proximity to the light assembly 30. The light assembly 30 may include a light or lights 31, which may include a single light or a plurality of lights. The light 31 may be any appropriately configured light, including a light emitting diode (LED), an incandescent light, a halogen light, any medical grade light, or any other source of illumination. The display screen 32 may further have engaged therewith speaker assemblies 36 for outputting audible sounds or a wireless transmitter for wireless sound transmission. These audible sounds may be configured for cooperation with any images or videos being displayed by the display screen 32 in order to offer a therapeutic or pleasing audio and visual output for viewing by the patient. The display screen 32 may be any appropriately configured screen and may display images or video that is configured for focusing the patient's attention to the display screen 32.

Figure 2:
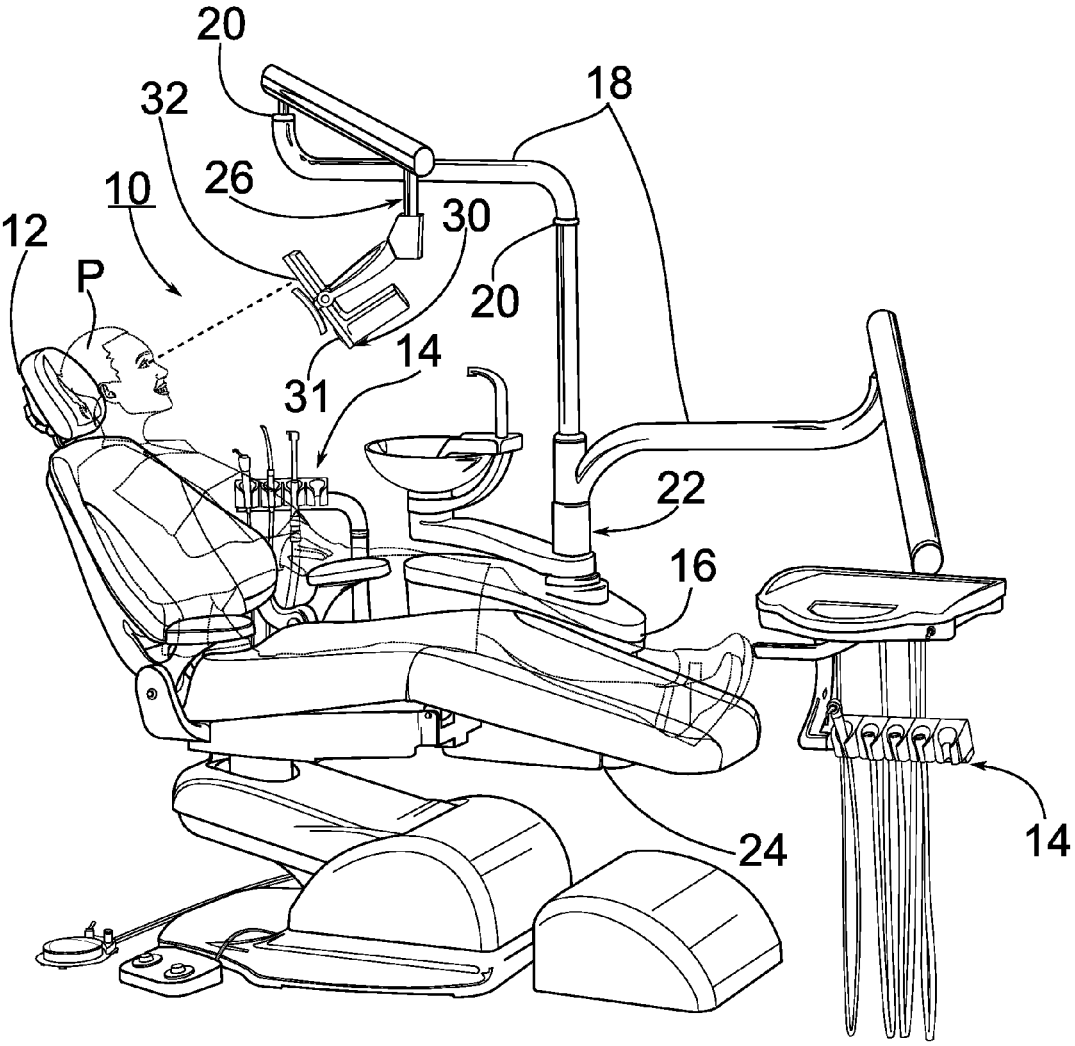
FIG. 2 illustrates a perspective view of a patient module having a light with a display screen carried thereby according to one or more embodiments disclosed herein.
Figure 3:
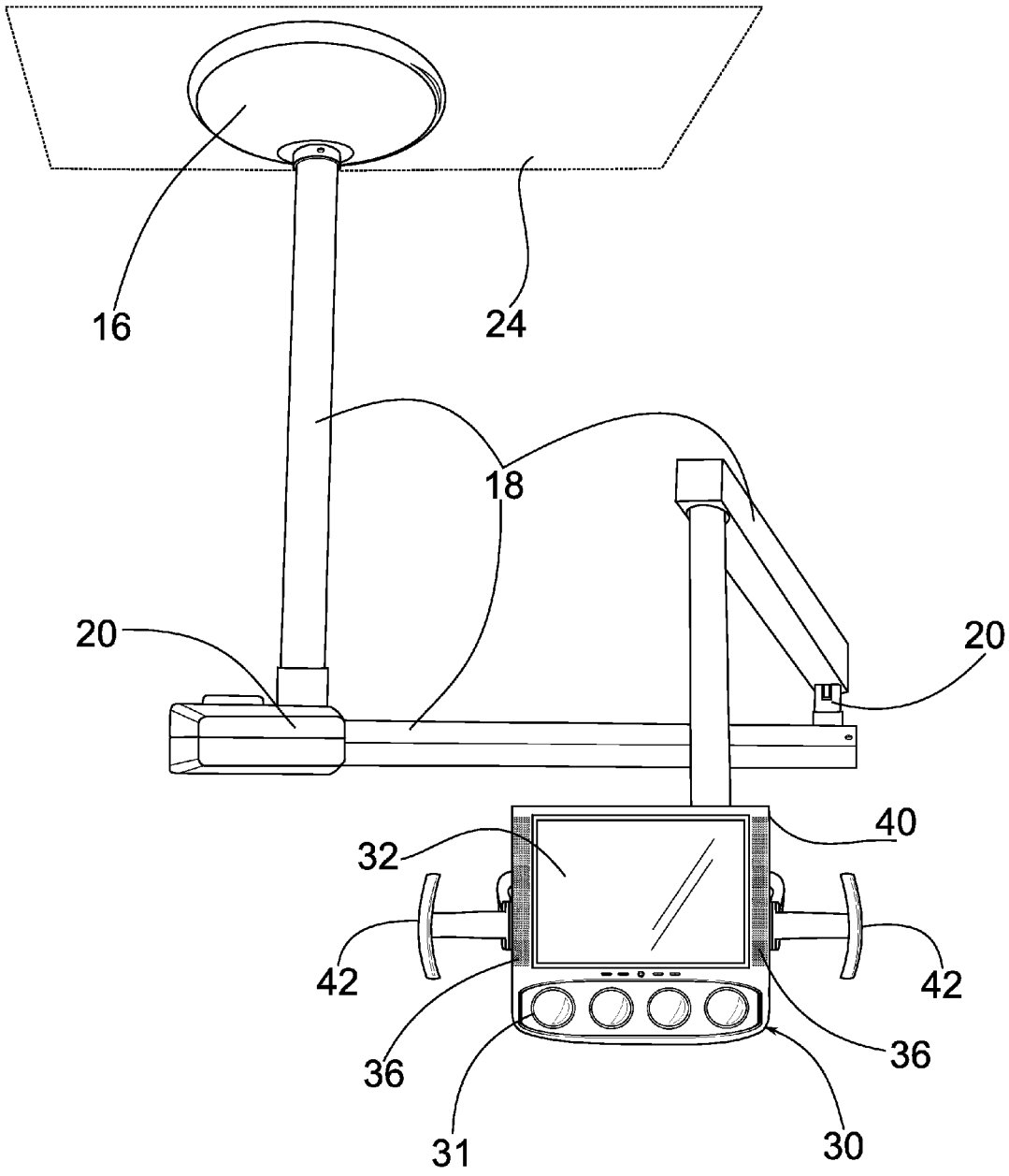
FIG. 3 illustrates a front view of a light assembly with a display screen according to one or more embodiments disclosed herein.
Figure 4:
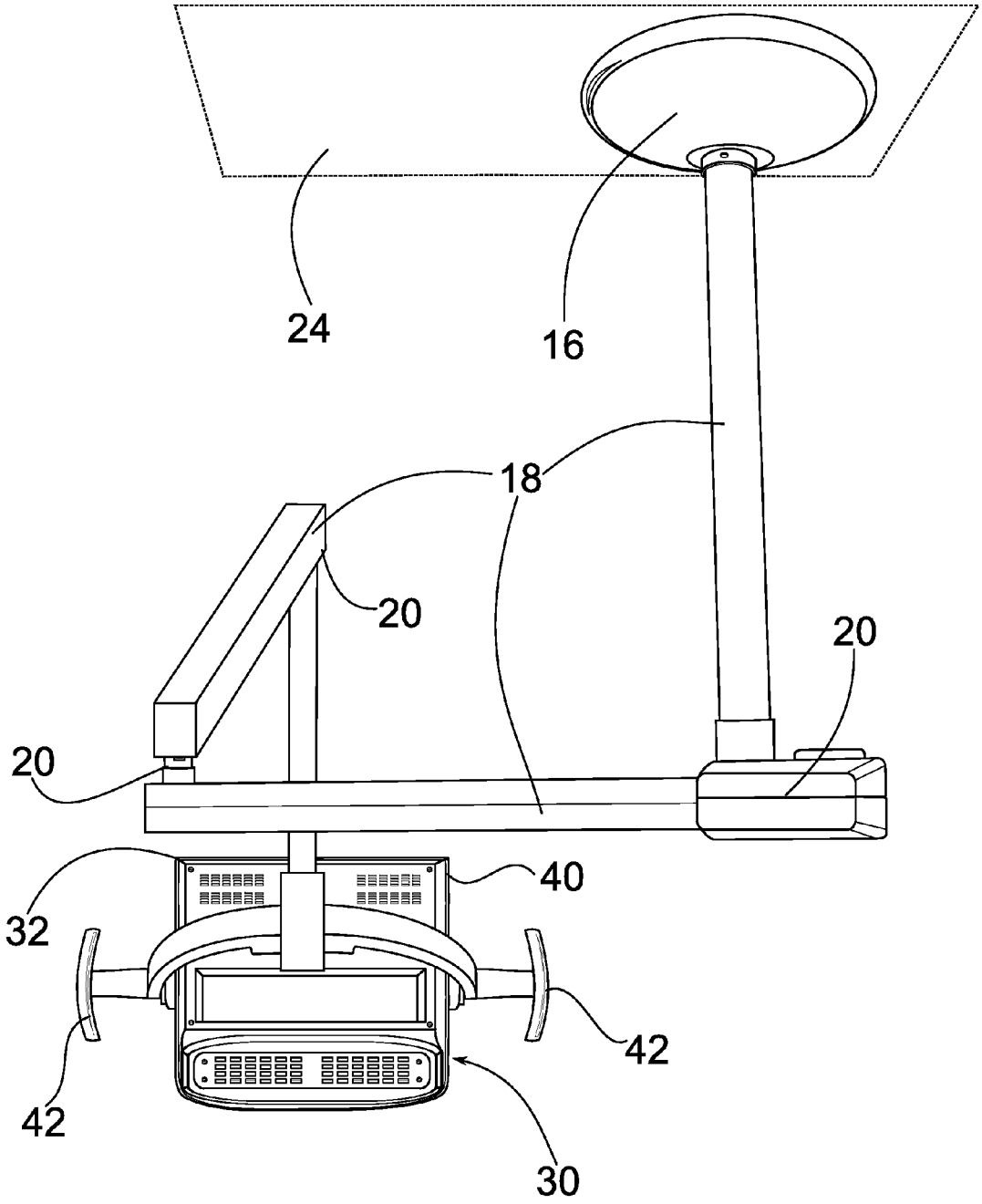
FIG. 4 illustrates a rear view of a light assembly with a display screen according to one or more embodiments disclosed herein.
Figure 5:
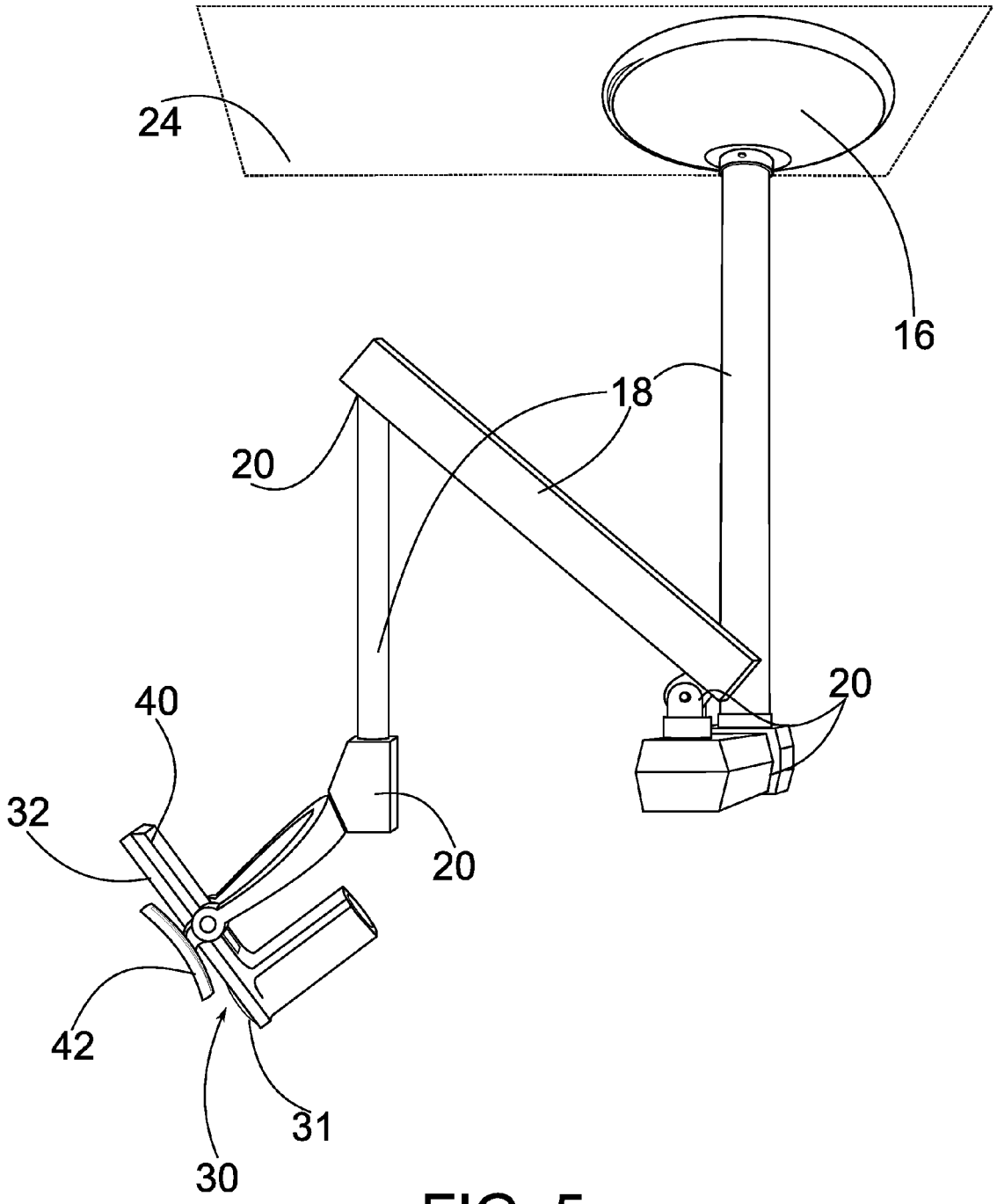
FIG. 5 illustrates a side view of a light assembly with a display screen according to one or more embodiments disclosed herein.
Figure 6:
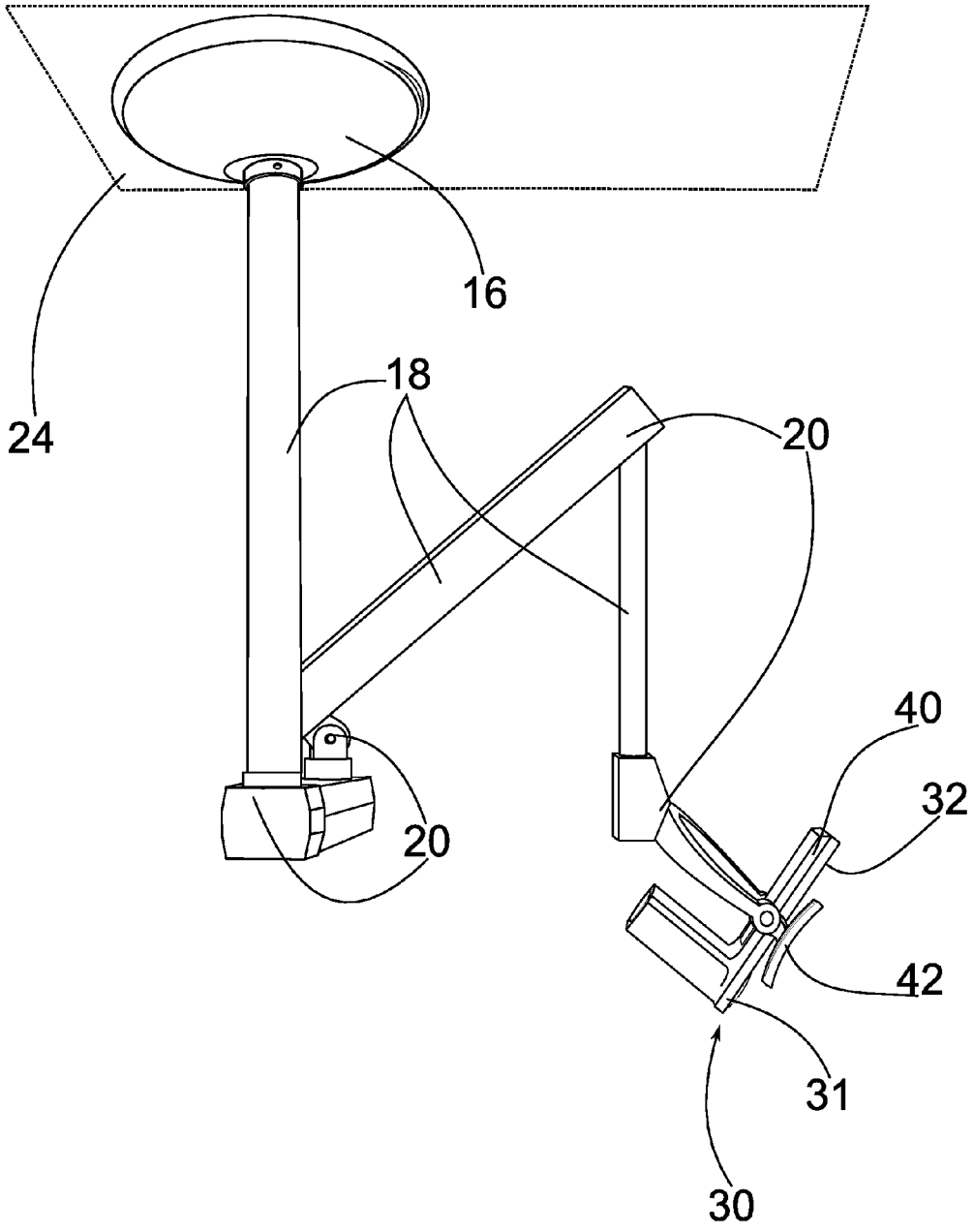
FIG. 6 illustrates a side view of a light assembly with a display screen according to one or more embodiments disclosed herein.
Figure 7:
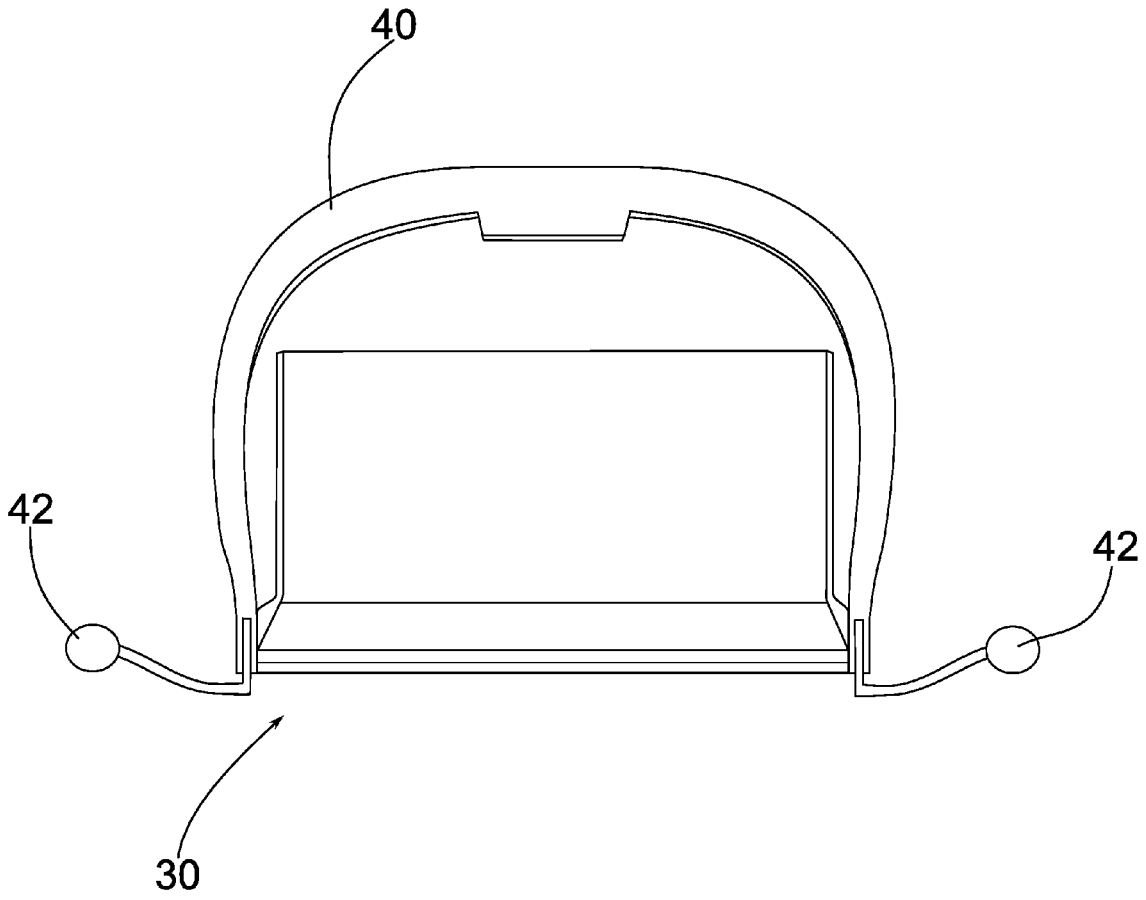
FIG. 7 illustrates a bottom view of a light assembly with a display screen according to one or more embodiments disclosed herein.

As illustrated in FIG. 2, the display screen 32 may be positioned on an upward facing portion of the light assembly 30 such that the screen 32 is above or anywhere about the light 31. In this manner, the screen 32 may be positioned within the eyesight line (depicted as a broken line in FIG. 2) of the patient while the light 31 broadcasts light towards the treatment area, which is illustrated as a patient' mouth in the example in FIG. 2. This is advantageous as the medical service provider can have appropriate access to the treatment area of the patient, while the patient can be maintained in a more relaxed state while focusing their eyesight on the display screen 32 without having to significantly move or reposition their head.

As used herein, the patient and treatment area may be described for use in a medical setting, or may alternatively be used to describe any setting in which a person or other is being operated on or otherwise treated. For example, the patient module 10 could be used for applying, for example, a tattoo to a person.

In one or more embodiments, each of the light assembly 30 and the display screen 32 may be defined within an integrally formed housing 40. In this manner, the housing 40 may be injection molded and assembled together with the light assembly 30 and display screen 32. The housing 40 may further define one or more handles 42 for receiving movement forces from an operator such as a physician. One or more current carrying wires may be positioned within the member 18 and extending from a power source for providing power to the light assembly 30 and display screen 32.

Alternatively, in one or more embodiments, the display screen 32 may be configured for being selectively carried by the light assembly 30 such that the display screen 32 is selectively attachable and detachable therefrom.

One or more embodiments of a light assembly are illustrated in FIGS. 3 through 7 in which a support 16 is carried by a structure 24 which is illustrated as a ceiling panel. This light assembly shares many features similar to the light assembly illustrated in FIGS. 1 through 2, with the structure 24 into which the support 16 is engaged with being a ceiling panel instead of the patient seating assembly.

Figure 8:
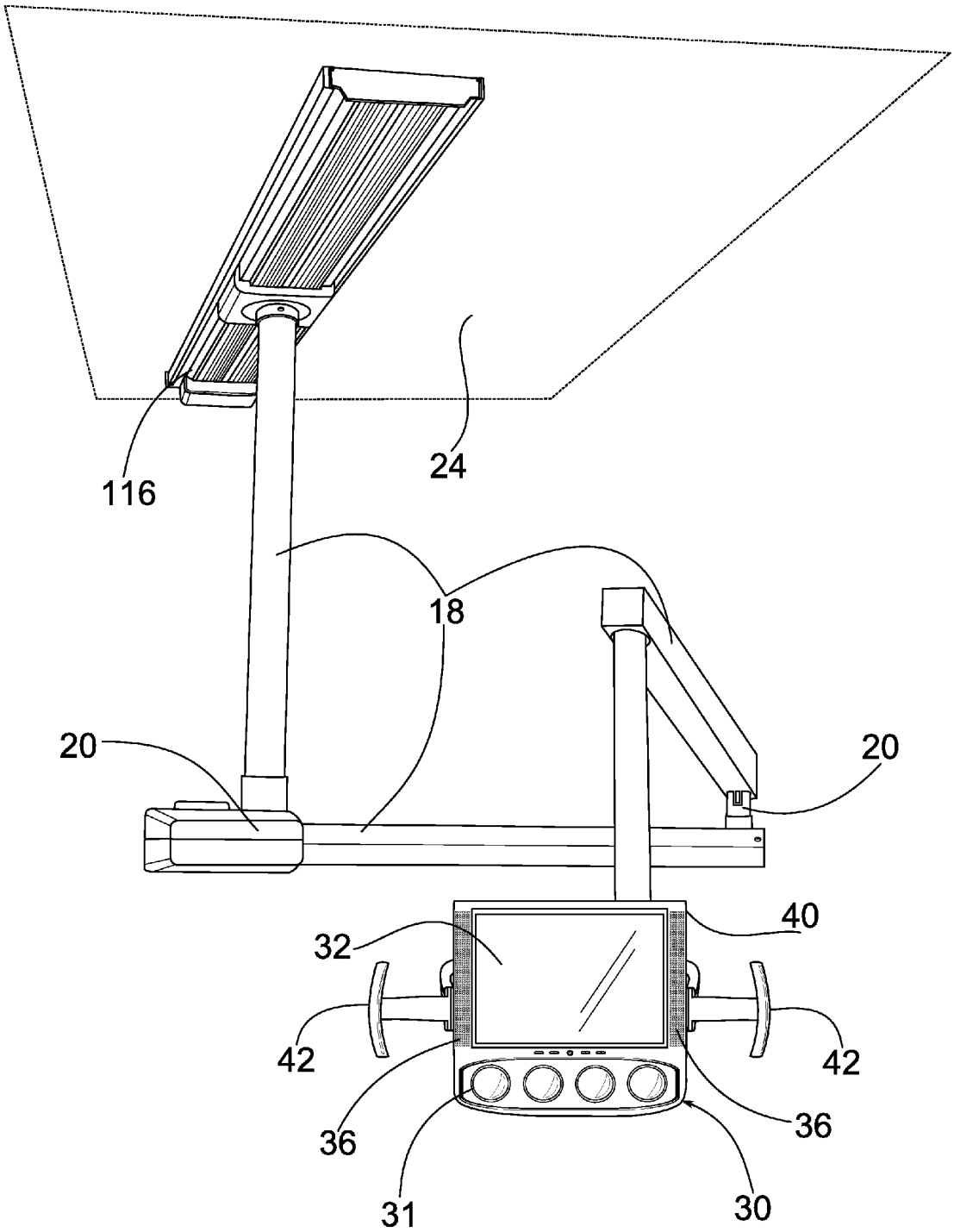
FIG. 8 illustrates a front-facing perspective view of a light assembly with a display screen according to one or more embodiments disclosed herein.

One or more alternate embodiments of a light assembly are illustrated in FIG. 8 in which the member 18 is engaged with a track assembly 116 that is carried by structure 24. This light assembly shares many features similar to the light assembly illustrated in FIGS. 1 through 2, with the structure 24 into which the support 16 is engaged with the track assembly 116 instead of the patient seating assembly. The track assembly 116 allows for movement of the light assembly 30 about structure 24 to a desired position.

Figure 9:
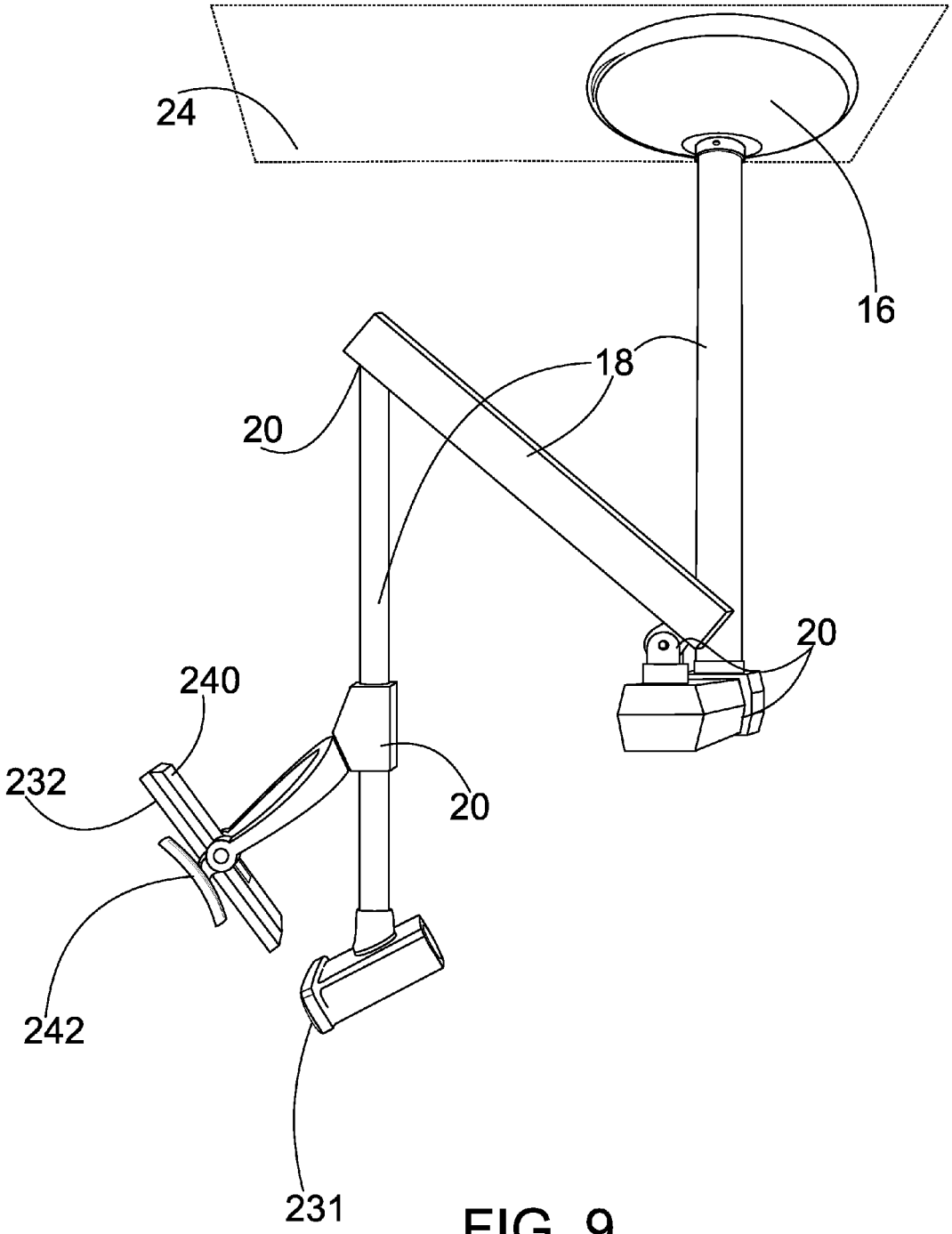
FIG. 9 illustrates a side view of a light assembly with a display screen according to one or more embodiments disclosed herein.

One or more alternate embodiments of a light assembly are illustrated in FIG. 9 in which the display screen 232 and housing 240 are carried on a pivoted joint 20 about member 18 and the light 231 is carried separate from the display screen 232. In these one or more embodiments, the light 231 is positioned to a desired treatment area of the patient and then the display screen 232 is pivoted until viewable by the patient. The light 231 may be configured with pivoting capabilities such that the light 231 can be positioned in a desired arrangement.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. A light fixture assembly comprising:

a support that includes at least one member having an articulated joint, the support having a first end configured for engagement with a structure and a second end configured for engagement with a light for illuminating a treatment area of a patient; and a display screen carried by the light for displaying images for viewing by the patient.

2. The light fixture assembly according to claim 1, wherein the at least one member comprises a plurality of members, each successive member being engaged to each prior member by the articulated joint.

3. The light fixture assembly according to claim 1, wherein the display screen is carried on an uppermost surface of the light.

4. The light fixture assembly according to claim 1, further including speaker assemblies carried by the display screen for outputting audible sounds.

5. The light fixture assembly according to claim 1, wherein each of the light and the display screen are defined within an integrally formed housing.

6. The light fixture assembly according to claim 1, wherein the casing further defines one or more handles for receiving movement forces from an operator.

7. The light fixture assembly according to claim 1, wherein the structure is one of a patient seating assembly and a ground surface.

8. A light assembly for use in a medical setting, the light assembly comprising:

a light for illuminating a treatment area of a patient; and a display screen carried by the light for displaying images for viewing by the patient.

9. The light assembly according to claim 8, wherein the at least one member comprises a plurality of members, each successive member being engaged to each prior member by the articulated joint.

10. The light assembly according to claim 8, wherein the display screen is carried on an uppermost surface of the light.

11. The light assembly according to claim 8, further including speaker assemblies carried by the display screen for outputting audible sounds.

12. The light assembly according to claim 8, wherein each of the light and the display screen are defined within an integrally formed housing.

13. The light assembly according to claim 8, wherein the casing further defines one or more handles for receiving movement forces from an operator.

14. The light assembly according to claim 8, wherein the structure is one of a patient seating assembly and a ground surface.

15. A patient module for use in a medical setting, the patient module comprising:

a patient seating assembly;

at least one of a medical instrument for use in providing treatment to a patient;

a support that includes at least one member having an articulated joint, the support having a first end configured for engagement with a structure and a second end configured for engagement with a light for illuminating a treatment area of the patient; and a display screen carried by the light for displaying images for viewing by the patient.

16. The patient module according to claim 15, wherein the display screen is carried on an uppermost surface of the light.

17. The patient module according to claim 15, further including speaker assemblies carried by the display screen for outputting audible sounds.

18. The patient module according to claim 15, wherein each of the light and the display screen are defined within an integrally formed housing.

19. The patient module according to claim 15, wherein the housing further defines one or more handles for receiving movement forces from an operator.

20. The patient module according to claim 15, wherein the structure is one of a patient seating assembly and a ground surface.

* * * * *